US006137502A

United States Patent [19]

Anderson et al.

[11] Patent Number: 6,137,502

[45] Date of Patent: Oct. 24, 2000

[54] DUAL DROPLET SIZE PRINTHEAD

[75] Inventors: Frank Edward Anderson, Sadieville; John Philip Bolash; Robert Wilson Cornell, both of Lexington; George Keith Parish, Winchester, all of Ky.

[73] Assignee: Lexmark International, Inc., Lexington, Ky.

[21] Appl. No.: 09/384,803

[22] Filed: Aug. 27, 1999

[51] Int. Cl.[7] ..... B41J 2/205; B41J 2/05

[52] U.S. Cl. ..... 347/15; 347/57

[58] Field of Search ..... 347/56, 57, 58, 347/15, 59

[56] References Cited

U.S. PATENT DOCUMENTS

| | | |
|---|---|---|
| 4,719,477 | 1/1988 | Hess . |
| 4,746,935 | 5/1988 | Allen . |
| 5,030,971 | 7/1991 | Drake et al. . |
| 5,075,250 | 12/1991 | Hawkins et al. . |
| 5,122,812 | 6/1992 | Hess et al. . |
| 5,159,353 | 10/1992 | Fasen et al. . |
| 5,208,605 | 5/1993 | Drake . |
| 5,357,081 | 10/1994 | Bohorquez . |
| 5,412,410 | 5/1995 | Rezanka . |
| 5,521,522 | 5/1996 | Hock et al. . |
| 5,635,968 | 6/1997 | Bhaskar et al. . |
| 5,745,131 | 4/1998 | Kneezel et al. . |
| 6,030,065 | 2/2000 | Fukuhata . |

FOREIGN PATENT DOCUMENTS

| | | | |
|---|---|---|---|
| 613781 | 2/1994 | European Pat. Off. | 347/15 |
| 0 805 029A2 | 11/1997 | European Pat. Off. . | |

*Primary Examiner*—John Barlow
*Assistant Examiner*—Juanita Stephens
*Attorney, Agent, or Firm*—Michael T. Sanderson; Luedeka, Neely & Graham

[57] ABSTRACT

An ink jet print head has first nozzles of a first diameter for ejecting droplets of ink having a first mass, and second nozzles of a second diameter for ejecting droplets of ink having a second mass. The first diameter is larger than the second diameter, and the first mass is larger than the second mass. First and second heater-switch pairs are connected in parallel on a substrate of the print head. The first heater-switch pairs include first heaters adjacent corresponding first nozzles, and the second heater-switch pairs include second heaters adjacent corresponding second nozzles. The first and second heaters are composed of electrically resistive material occupying first and second heater areas on the substrate. The first heater-switch pairs also include first switching devices connected in series with the first heaters, with each first switching device developing a first switching device voltage drop as a first electrical current flows through. The second heater-switch pairs include second switching devices connected in series with the second heaters, with each second switching device developing a second switching device voltage drop as a second electrical current flows through. The first heater area is larger than the second heater area, thus matching heater area to nozzle diameter to provide for more efficient transfer of thermal energy to the ink. The voltage drop across each first switching device is substantially equivalent to the voltage drop across each second switching device, thus reducing undesirable nozzle-to-nozzle variations in the amount of energy delivered to the ink.

20 Claims, 9 Drawing Sheets

Section 100-100

Section 100-100 (See Fig. 3)

DUAL DROPLET SIZE PRINTHEAD

FIELD OF THE INVENTION

The present invention is generally directed to an ink jet print head for printing ink droplets of multiple sizes. More particularly, the invention is directed to an ink jet print head having heating elements and switching transistors of multiple sizes for printing ink droplets of multiple sizes.

BACKGROUND OF THE INVENTION

Due to their high quality printed output and reasonable cost, the market for ink jet printers is currently expanding. As the market's appetite for ink jet printers grows, so does its expectation of improved image quality. A goal of ink jet printer design is to achieve image quality approaching that of continuous tone images, such as photographs. One approach to achieving photo quality images is increasing the number of gray-scale levels that the ink jet printer can produce.

Ink jet printers form images on paper by ejecting ink droplets from nozzles in a print head. Heating elements in the print head heat the ink causing bubbles to form which force the ink from the nozzles. By printing pixels using combinations of ink droplets of multiple sizes, the number of gray-scale levels produced by an ink jet printer can be increased.

One approach to producing ink droplets of multiple sizes is to eject the droplets from nozzles of multiple sizes. However, using multiple nozzle sizes without a corresponding adjustment in heater resistor size is not energy efficient. Multiple-size droplets can be achieved in a more energy-efficient manner by adjusting the size of the heating elements in relation to the size of the ink droplets to be ejected from the nozzles.

However, varying heating element sizes in an ink jet print head can cause undesirable variations in the energy delivered to the ink. These variations in energy reduce the overall quality of the printed image.

Therefore, an ink jet print head is needed that is capable of printing ink droplets of multiple sizes without undesirable variations in the amount of energy delivered to the ink.

SUMMARY OF THE INVENTION

The foregoing and other needs are met by an ink jet print head having a plurality of nozzles for ejecting droplets of ink toward a print medium. The plurality of nozzles include first nozzles having a first diameter for ejecting droplets of ink having a first mass, and second nozzles having a second diameter for ejecting droplets of ink having a second mass. The first diameter is larger than the second diameter, and the first mass is larger than the second mass. The print head includes a nozzle plate containing the plurality of nozzles and a substrate disposed adjacent the nozzle plate.

First heaters are located on the substrate adjacent the first nozzles, where each of the first heaters is associated with a corresponding first nozzle. Each first heater is composed of electrically resistive material occupying a first heater area on the substrate and has a first heater electrical resistance. Each of the first heaters generate heat as a first electrical current flows substantially in a first direction through the electrically resistive material. First switching devices are also disposed on the substrate adjacent the first heaters. Each first switching device, which has a first switch electrical resistance, is connected in series with a corresponding first heater.

Second heaters are located on the substrate adjacent the second nozzles, where each of the second heaters is associated with a corresponding second nozzle. Each second heater is composed of electrically resistive material occupying a second heater area on the substrate and has a second heater electrical resistance. Each of the second heaters generate heat as a second electrical current flows substantially in the first direction through the electrically resistive material. Second switching devices are disposed on the substrate adjacent to, and electrically in series with, the second heaters.

In preferred embodiments of the invention, the first heater electrical resistance is smaller than the second heater electrical resistance, and the first switch electrical resistance is smaller than the second switch electrical resistance.

In other preferred embodiments of the invention, the voltage drop across each first switching device is substantially equivalent to the voltage drop across each second switching device. This feature of the invention reduces undesirable nozzle-to-nozzle variations in the amount of energy delivered to the ink. By reducing the nozzle-to-nozzle variations in the energy delivered to expel ink from the nozzles, the invention significantly enhances print quality.

The first heaters each occupy a first heater area on the substrate defined by a first heater length in the first direction and a first heater width in a second direction which is orthogonal to the first direction. The second heaters each occupy a second heater area on the substrate defined by a second heater length in the first direction and a second heater width in the second direction. In preferred embodiments of the invention, the second heater width is smaller than the first heater width, the second heater length is larger than the first heater length and the second heater area is smaller than the first heater area. Since heater area is proportional to the thermal energy generated by the heater to expel ink from its associated nozzle, the invention provides for more efficient transfer of thermal energy to the ink by relating the heater area to the nozzle diameter.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
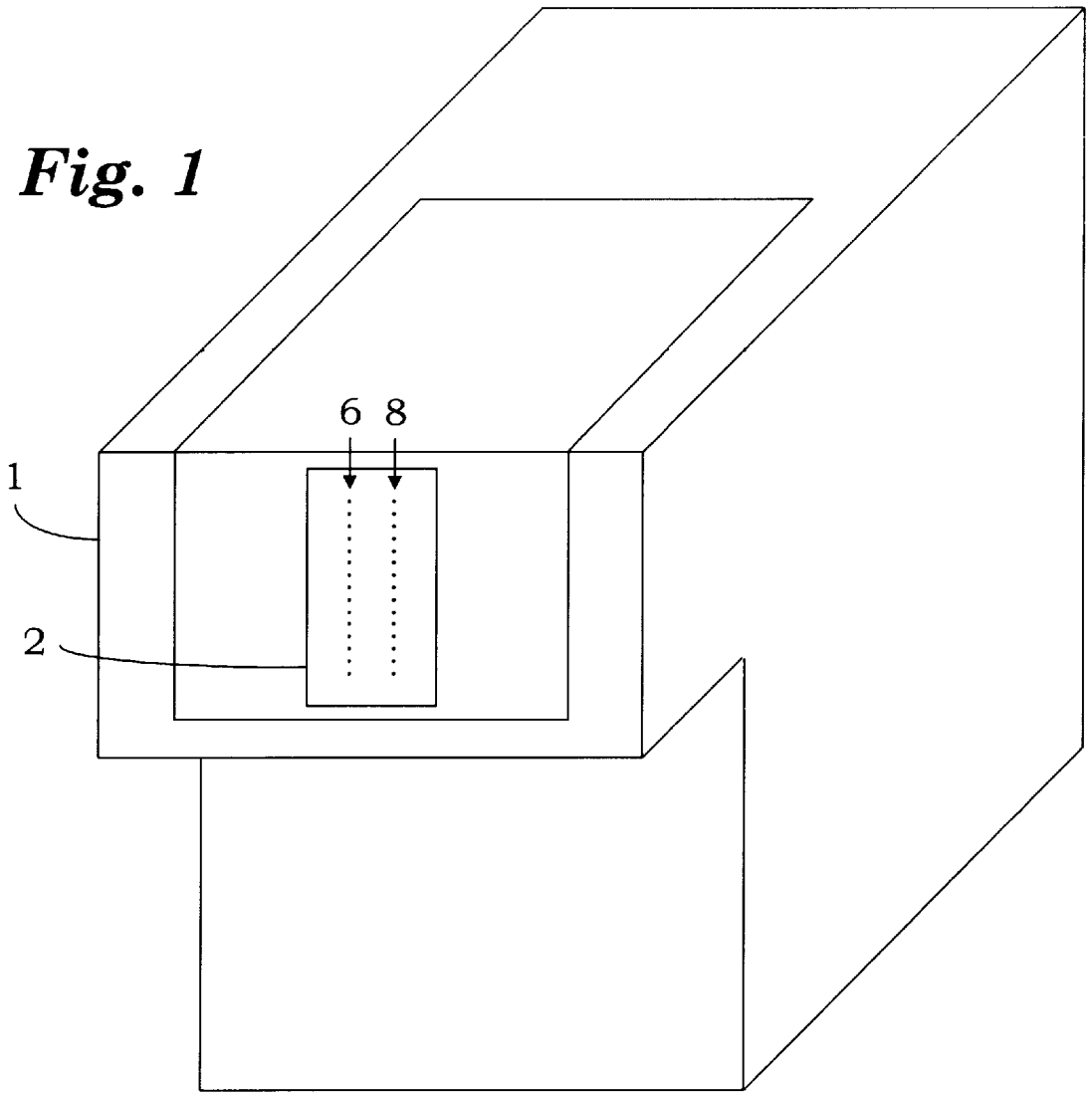
FIG. 1 depicts an ink jet print head according to a preferred embodiment of the invention.
Figure 2:
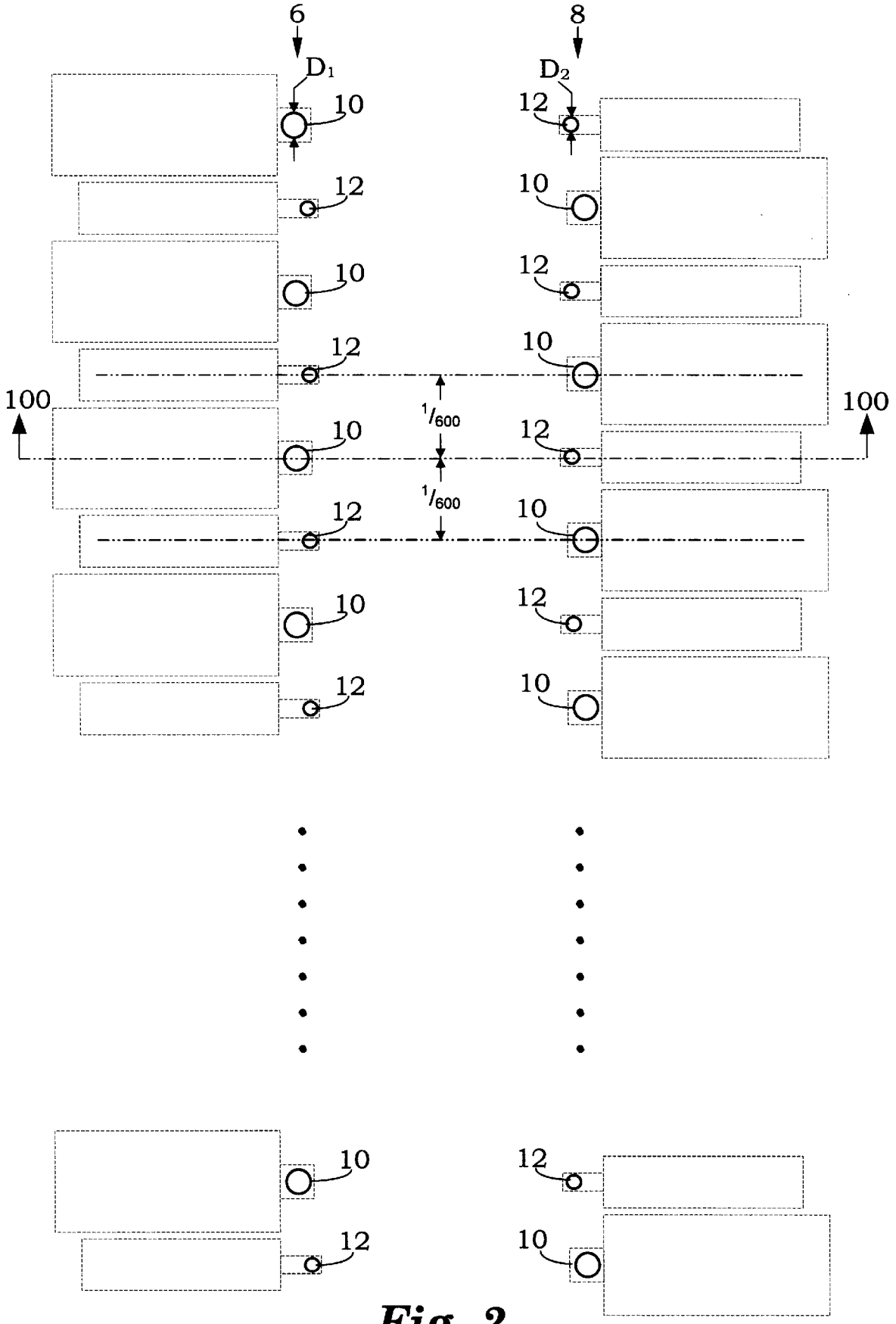
FIG. 2 depicts an array of nozzles in a nozzle plate of the print head according to a preferred embodiment of the invention.

Shown in FIG. 1 is an ink jet print head 1 having a nozzle plate 2 with an array of nozzles arranged in a left column 6 and a right column 8. FIG. 2 shows an enlarged view of the array of nozzles in the nozzle plate 2. The array of nozzles includes first nozzles 10 and second nozzles 12, where the positions of the first nozzles 10 alternate with the positions of the second nozzles 12 in each of the columns 6 and 8. Each first nozzle 10 in the left column 6 is in horizontal alignment with a second nozzle 12 in the right column 8, and each first nozzle 10 in the right column 8 is in horizontal alignment with a second nozzle 12 in the left column 6. In the preferred embodiment of the invention, the vertical spacing between neighboring nozzles within each column is 1/600 inch.

As depicted in FIG. 2, the first nozzles 10 have a diameter $D_1$ which is larger than the diameter $D_2$ of the second nozzles 12. Hereinafter, the first nozzles 10 and the second nozzles 12 are also referred to as the large nozzles 10 and the small nozzles 12. As discussed in more detail below, the diameters $D_1$ and $D_2$ are determined based upon the mass of the ink droplets to be ejected from the nozzles.

In the preferred embodiment of the invention, the large nozzles 10 eject ink droplets each having a mass of approximately 6 nanograms (ng) and the small nozzles 12 eject ink droplets each having a mass of approximately 2 ng. Using combinations of the large and small droplets as shown in Table I, the invention prints pixels having eight different dot densities. Since a large and a small nozzle are in horizontal alignment at each vertical position, a large and a small droplet can be printed at a single pixel location during a single pass of the print head 1 across the paper without having to move the paper vertically with respect to the print head 1.

TABLE I

| State | Ink Mass Ejected in First Pass (ng) | Ink Mass Ejected in Second Pass (ng) | Total Mass (ng) |
|---|---|---|---|
| 1 | 0 | 0 | 0 |
| 2 | 2 | 0 | 2 |
| 3 | 2 | 2 | 4 |
| 4 | 6 | 0 | 6 |
| 5 | 6 + 2 | 0 | 8 |
| 6 | 6 + 2 | 2 | 10 |
| 7 | 6 | 6 | 12 |
| 8 | 6 + 2 | 6 | 14 |

As indicated in Table I, three bits per pixel describe the eight dot density levels ($2^3$=8). State 1 is a blank pixel, where no ink is ejected. State 2, the lightest printed gray-scale level, is achieved by ejecting a single 2 ng droplet at a pixel location. State 3 is achieved by printing two 2 ng droplets at the same pixel location, resulting in a pixel formed by 4 ng of ink. For state 3, a first droplet is printed during a first pass of the print head 1 across the paper, and a second droplet is printed during a second pass. State 4 is achieved by printing a single 6 ng droplet at a pixel location. A state 5 pixel is formed by 8 ng of ink printed by ejecting a 2 ng droplet and a 6 ng droplet during a single pass of the print head 1. With continued reference to Table I, states 6, 7, and 8 describe pixels formed by 10, 12, and 14 ng of ink, respectively, printed during two passes of the print head 1.

Figure 3:
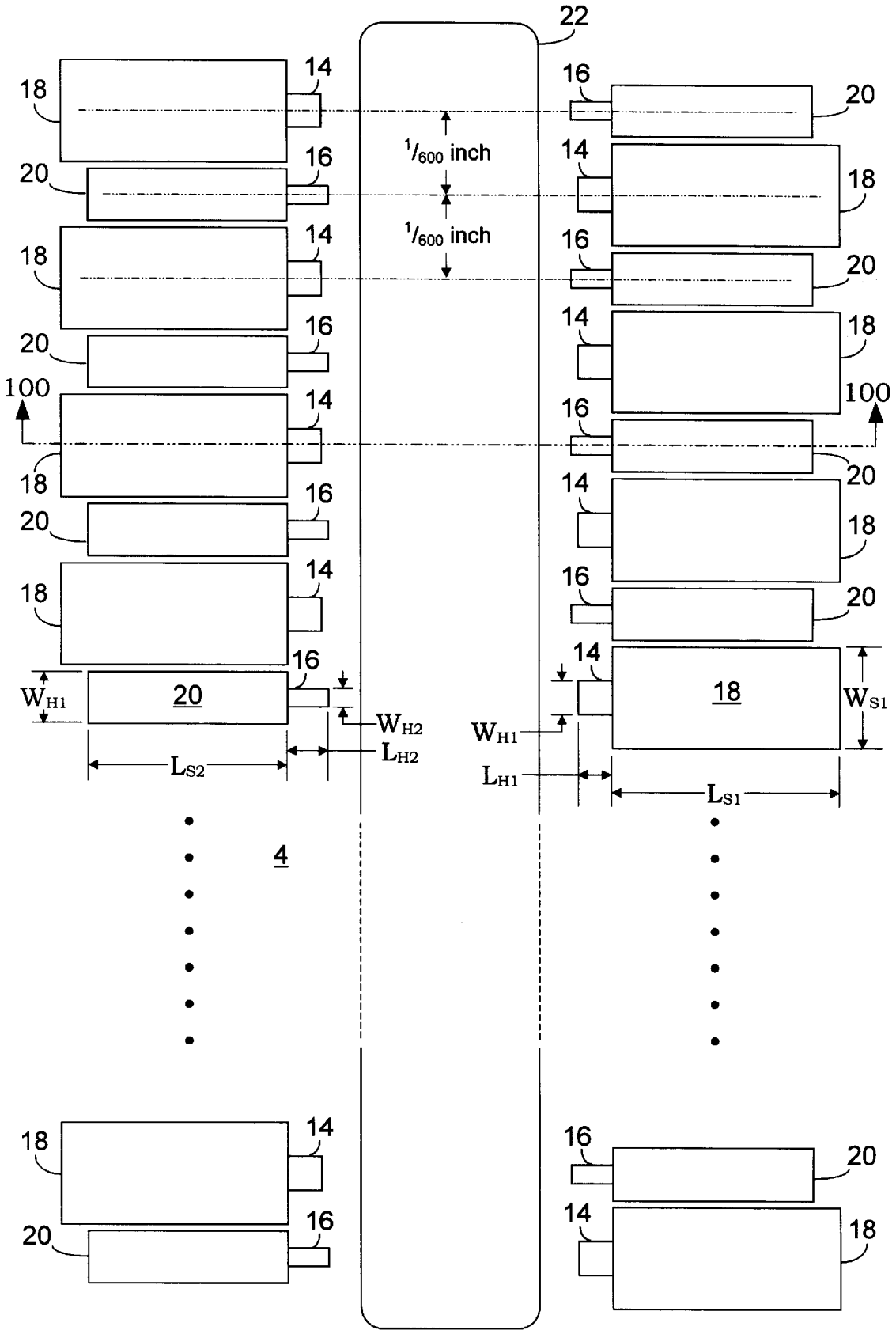
FIG. 3 depicts an arrangement of heaters and switching devices on a substrate of the print head according to a preferred embodiment of the invention.
Figure 4:
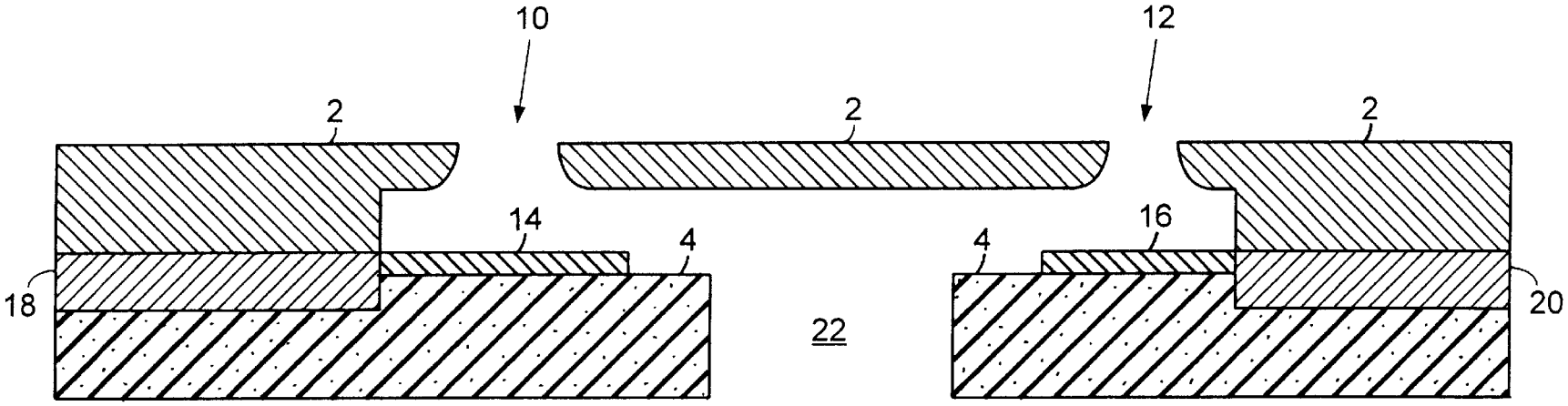
FIG. 4 is a cross-sectional view of a nozzle plate and substrate structure according to a preferred embodiment of the invention.

Shown in FIG. 3 are features formed on a semiconductor substrate 4 of the ink jet print head 1. As indicated in the cross-sectional view of FIG. 4, the substrate 4 is disposed below the nozzle plate 2. On the substrate are first heaters 14 and second heaters 16 consisting of rectangular patches of electrically resistive material. In the preferred embodiment of the invention, the first and second heaters 14 and 16 are formed from TaAl thin film, which has a sheet resistance of approximately 28 ohms per square. As an electric current flows through the heaters 14 and 16, they generate heat. Ink is fed to a chamber imediately above the heaters 14 and 16 through an ink via 22. As the ink is heated by a heater 14 or 16, an ink bubble forms which expels ink through the nozzle 10 or 12.

Since the small nozzles 12 eject smaller ink droplets, a smaller bubble is needed to expel the ink. Given a particular energy density on the surface of a heater, the size of an ink bubble formed by the heater is proportional to the size of the heater. Thus, as shown in FIG. 3, the second heaters 16 of the present invention are smaller in area than the first heaters 14. The first heaters 14 have a length $L_{H1}$ and a width $W_{H1}$ which, in the preferred embodiment, define an area of approximately 441 square microns. The second heaters 16 have an area of approximately 276 square microns defined by a length $L_{H2}$ and a width $W_{H2}$. Hereinafter, the first and second heaters 14 and 16 are also referred to as the large and small heaters 14 and 16. Given the same energy density, the large heaters 14 form larger ink bubbles than do the small heaters 16. This design is more energy-efficient than a design which uses a single heater size for both nozzle sizes.

For the large and small heaters 14 and 16 to be electrically and thermodynamically compatible, they should operate at the same energy density and power density. Also, as discussed in more detail below, it is desirable to connect the large and small heaters 14 and 16 to the same voltage source. Generally, the power density generated by a large heater 14 is defined by:

$$PD_1 = \frac{I_1^2 \times R_{H1}}{A_1}, \tag{1}$$

where $I_1$ is the current through the large heater 14 in amperes, $R_{H1}$ is the resistance of the large heater 14 in ohms, and $A_1$ is the area of the large heater 14. Similarly, the power density generated by a small heater 14 is defined by:

$$PD_2 = \frac{I_2^2 \times R_{H2}}{A_2}, \tag{2}$$

where $I_2$ is the current through the small heater 16 in amperes, $R_{H2}$ is the resistance of the small heater 16 in ohms, and $A_2$ is the area of the small heater 16. Thus, to approximately equalize $PD_1$ and $PD_2$, the following relationships should be satisfied:

$$\frac{I_1^2 \times R_{H1}}{A_1} \cong \frac{I_2^2 \times R_{H2}}{A_2}, \tag{3}$$

and $$\frac{A_2}{A_1} \cong \frac{I_2^2 \times R_{H2}}{I_1^2 \times R_{H1}}. \tag{4}$$

As discussed previously, the ratio of the heater areas, $A_2/A_1$, is determined by the relative energies needed to form the large and small bubbles.

According to the preferred embodiment of the invention, the relationship of equation (4) is satisfied by adjusting the electrical resistance $R_{H2}$ of the small heaters 16 relative to the electrical resistance $R_{H1}$ of the large heaters 14. This adjustment is made by taking advantage of the fact that:

$$R \propto \frac{\text{heater length}}{\text{heater width}} \tag{5}$$

for a sheet resistor. Thus, $R_{H2}$ may be increased by making:

$$W_{H2} < L_{H2} \tag{6}$$

while still maintaining the desired area $A_2$ of the small heater 16. In a preferred embodiment of the invention, $W_{H2}$ is 11.75 microns and $L_{H2}$ is 23.5 microns, resulting in an area $A_2$ of 276 square microns. Preferably, for each large heater 14, $W_{H1}$ and $L_{H1}$ are 21 microns, resulting in an area $A_1$ of 441 square microns. Thus, the resistance $R_{H2}$ is determined by:

$$\begin{aligned} R_{H2} &= \frac{\text{heater length}}{\text{heater width}} \times \text{sheet resistivity} \\ &= \frac{23.5\,\text{microns}}{11.75\,\text{microns}} \times 28\,\Omega/\text{square} \\ &= 56\,\text{ohms}. \end{aligned} \tag{7}$$

Since the large heaters are square, $R_{H1}$ is simply 28 ohms.

Figure 5A:
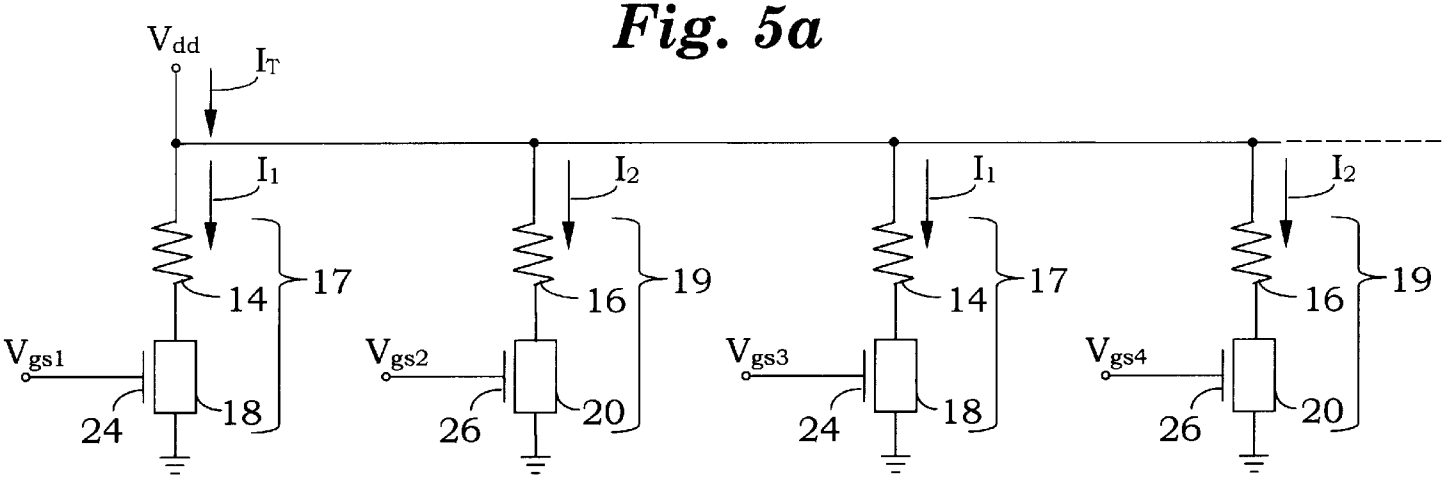
FIG. 5*a* is a schematic diagram of a switching circuit for selectively energizing heaters according to a preferred embodiment of the invention.

Shown in FIG. 5*a* is a schematic diagram of a switching circuit for selectively energizing the heaters 14 and 16 on the print head 1. First heater-switch pairs 17 are connected in parallel with second heater-switch pairs 19. Each first heater-switch pair 17 includes one of the first heaters 14 in series with a first switching device 18. Each second heater-switch pair 19 includes one of the second heaters 16 in series with a second switching device 20. In the preferred embodiment, the first and second switching devices 18 and 20 are MOSFET devices formed on the substrate 4. As shown in FIG. 5*a*, the heater-switch pairs 17 and 19 are connected to the same voltage source $V_{dd}$.

Figure 5B:
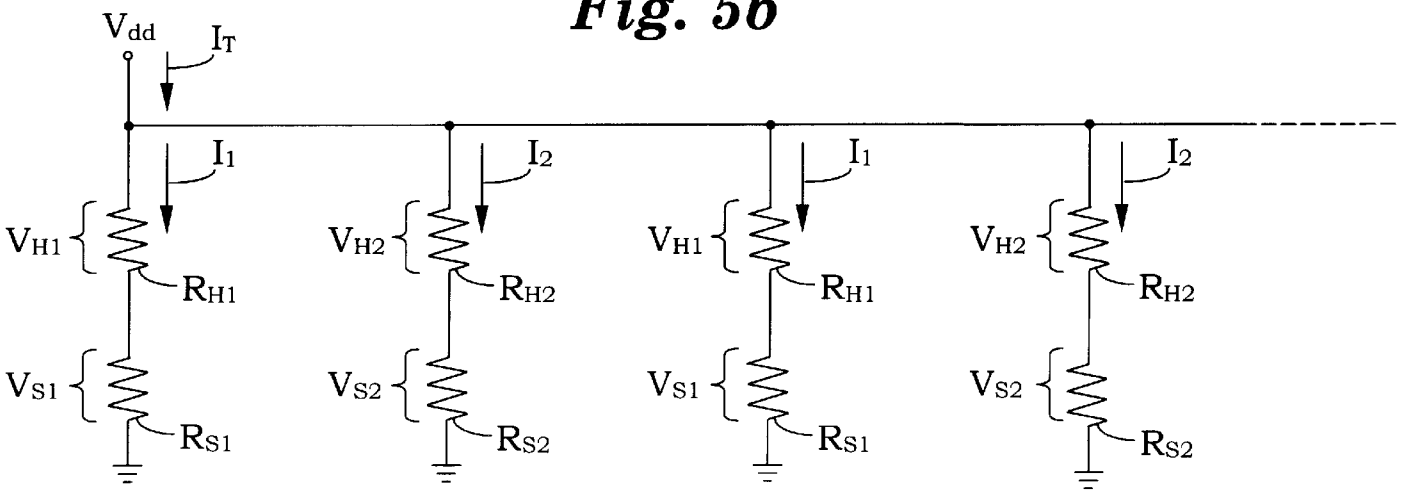
FIG. 5*b* is a schematic diagram of resistances introduced by the switching circuit according to a preferred embodiment of the invention.

When a voltage $V_{gs}$ of 10–12 volts is applied to a gate 24 of one of the MOSFET switching devices 18, the device 18 is enabled. When enabled, the device 18 allows a current $I_1$ to flow through the device 18 and the heater 14. It is the first heater's resistance $R_{H1}$ to the flow of the current $I_1$ that generates the heat to eject the large ink droplet. Thus, when the device 18 is enabled, it acts like a closed switch through which current may flow to activate the heater 14. However, as shown in FIG. 5*b*, the device 18 has a finite resistance $R_{S1}$ when enabled. As the current $I_1$ flows, a voltage drop $V_1$ develops across the large heater 14, and a voltage drop $V_{S1}$ develops across the resistance $R_{S1}$.

Similarly, when $V_{gs}$ is applied to a gate 26 of one of the MOSFET switching devices 20, the device 20 is enabled. When enabled, the device 20 allows a current $I_2$ to flow through the device 20 and the heater 16. Thus, when the device 20 is enabled, the heater 16 is activated. The voltage drop across the small heater 16 is $V_{H2}$. The device 20 has a finite resistance $R_{S2}$ across which the voltage drop $V_{S2}$ develops.

It will be appreciated that the circuits shown in FIGS. 5*a* and 5*b* are simplified for the purpose of illustrating the invention. A print head incorporating the present invention would typically also include switching devices other than those shown in FIG. 5*a*. For example, other switching devices may be included in a logic circuit for decoding multiplexed printer signals. Such circuits are typically incorporated to reduce the number of I/O signal lines required to carry print signals from a printer controller to a print head. However, these other switching circuits do not significantly affect the operation of the present invention as described herein. Thus, a detailed description of such circuits is not necessary to an understanding of the present invention.

One goal in ink jet print head design is to minimize heater-to-heater power variations. So that the size of the ink bubbles produced by same-sized heaters is consistent across the array, each large heater 14 should dissipate the same power as every other large heater 14, and each small heater 16 should dissipate the same power as every other small heater 16. If same-sized heaters dissipate differing amounts of power in generating heat to produce ink bubbles, undesirable variations in ink droplet size occur. Such variations in ink droplet size result in degraded print quality.

The present invention minimizes variations in dissipated power from heater to heater by approximately equalizing the voltage drops across all of the heaters 14 and 16, both large and small. Since the heater-switch pairs 17 and 19 are connected in parallel, equalizing the voltage drops across the heaters 14 and 16 requires equalizing the voltage drops across the switching devices 18 and 20. This design goal is achieved in the preferred embodiment of the invention by setting the switch resistances $R_{S1}$ and $RS_2$ according to the following relationship:

$$\frac{R_{S1}}{R_{S2}} \cong \frac{R_{H1}}{R_{H2}} \tag{8}$$

Since exemplary values of $R_{H1}$ and $R_{H2}$ were previously determined to be 28 ohms and 56 ohms, respectively, the relationship of equation (7) becomes:

$$\frac{R_{S1}}{R_{S2}} \cong \frac{28\,\Omega}{56\,\Omega} = 0.5. \tag{9}$$

Generally, the resistance of a MOSFET device, such as the switching device 18 and 20, is the sum of its source resistance, drain resistance, and channel resistance. The source and drain resistances of a MOSFET device are determined, at least in part, by the source-drain line widths of the device. As described in detail below, the preferred embodiment of the invention achieves the relationship of equation (9) by adjusting the source-drain line widths of the first and second switching devices 18 and 20.

Figure 6:
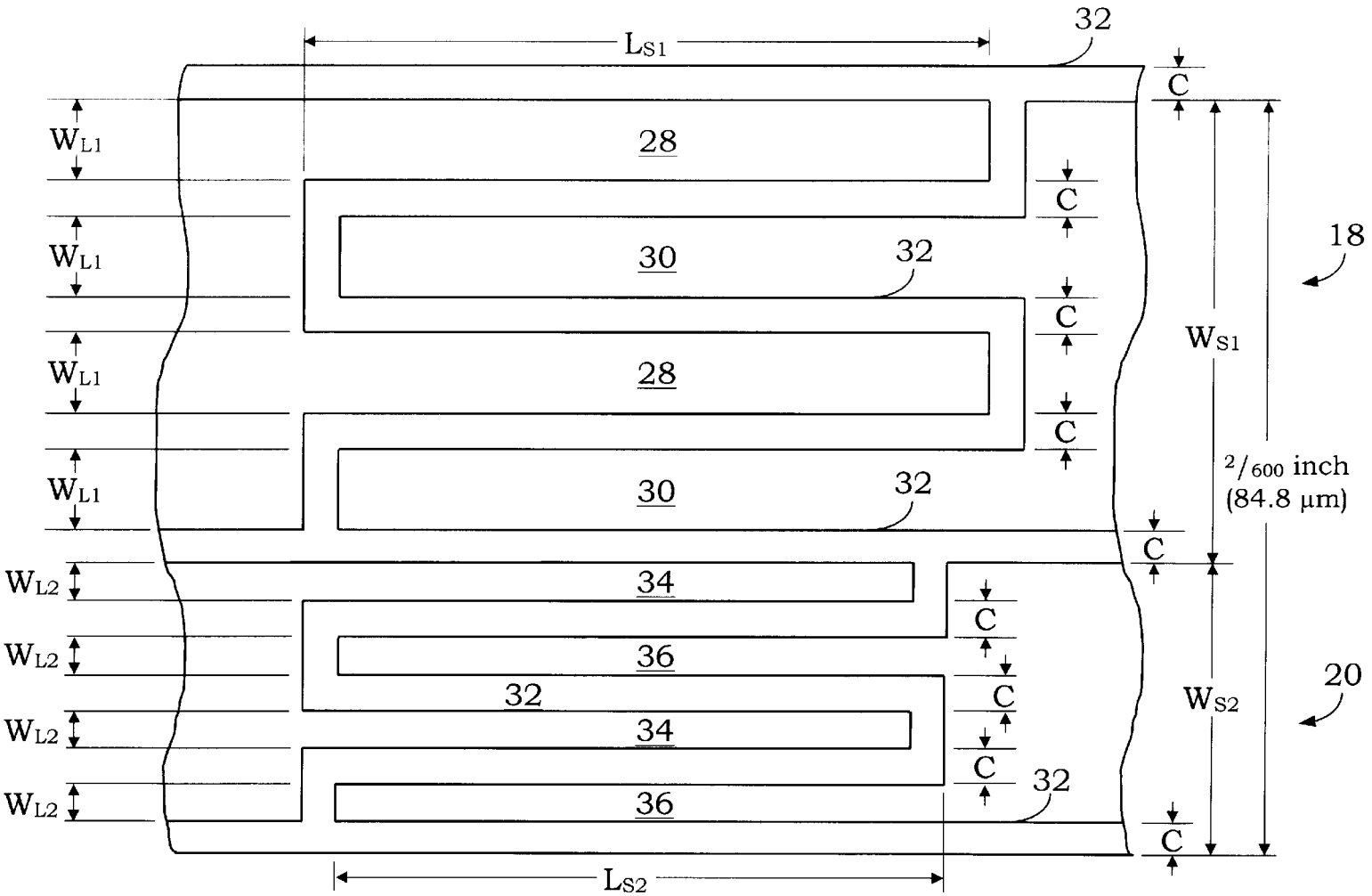
FIG. 6 depicts structures of adjacent first and second MOSFET switching devices on the print head substrate according to a preferred embodiment of the invention.

Shown in FIG. 6 is the structure of adjacent first and second MOSFET switching devices 18 and 20 on the substrate 4 according to a preferred embodiment of the invention. The first switching device 18 includes a source region 28 separated from a drain region 30 by a channel 32 having a width C. The source-drain line width of the first switching device 18 is represented by $W_{L1}$ and the channel length of the first switching device 18 is represented by $L_{S1}$. The second switching device 20 includes a source region 34 separated from a drain region 36 by the channel 32. The source-drain line width and the channel length of the second switching device 20 is represented by $W_{L2}$ and $L_{S2}$, respectively.

Preferably, as shown in FIGS. 2 and 3, adjacent nozzles and heaters are vertically spaced by 1/600 inch. Thus, as shown in FIG. 6, the total width that an adjacent pair of switching devices 18 and 20 may occupy is 2/600 inch or approximately 84.7 μm. This total width is allocated according to:

$$W_{S1}+W_{S2}=84.7\ \mu m, \text{ where} \quad (10)$$

$$W_{S1}=4(W_{L1})+4(C), \text{ and} \quad (11)$$

$$W_{S2}=4(W_{L2})+4(C). \quad (12)$$

Based on equations (10), (11), and (12), if C is 2.5 μm, the desired relationship between $W_{L1}$ and $W_{L2}$ is expressed as:

$$W_{L1}+W_{L2}=16.2\ \mu m. \quad (13)$$

Figure 7:
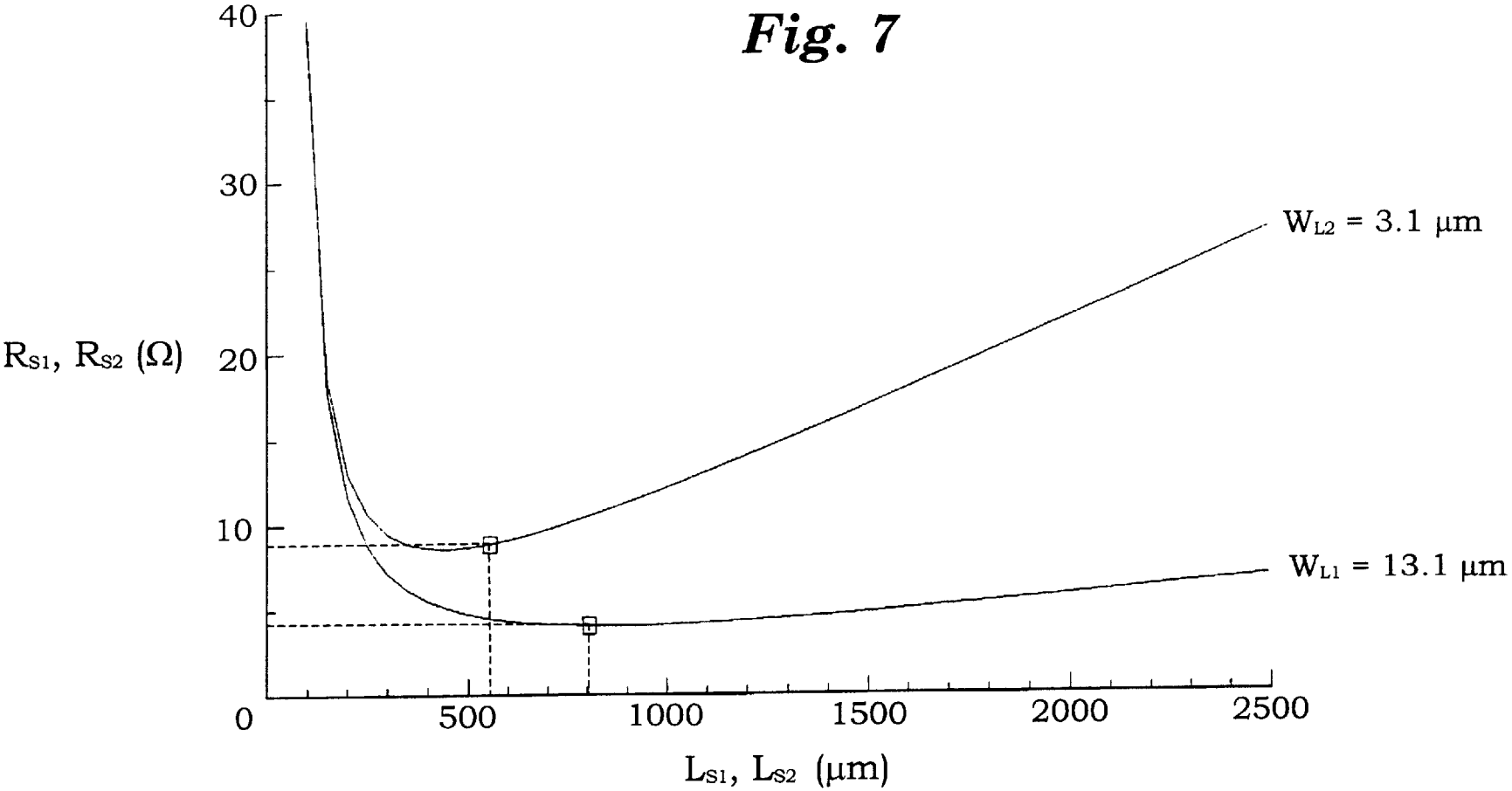
FIG. 7 is a graph based on a first order MOSFET device simulation showing device resistance versus device length for two device line widths.

FIG. 7 shows a summary solution for a first order simulation of the preferred MOSFET devices 18 and 20 which meets the requirements of equations (9)and (13). According to the simulation results, the preferred values for $W_{L1}$ and $W_{L2}$ are 13.1 and 3.1 μm, respectively. Also, as FIG. 7 indicates, a minimum value of $R_{S1}$, 4.3 Ω, results when $L_{S1}$ equals approximately 800 μm. If $R_{S1}$ equals 4.3 Ω, the relationship of equation (9) is satisfied when $R_{S2}$ equals 8.6 Ω. With continued reference to FIG. 7, when $RS_2$ equals 8.6 Ω, $L_{S2}$ equals approximately 570 μm. Thus, according to equations (11) and (12), $W_{S1}$ and $W_{S2}$ are approximately 62.3 μm and 22.4 μm, respectively. Therefore, the dimensional values for a preferred embodiment of the switching devices 18 and 20 are summarized as follows: $W_{L1}\cong 13.1$ μm, $W_{L2}\cong 3.1$ μm, $W_{S1}\cong 62.3$ μm, $W_{S2}\cong 22.4$ μm, $L_{S1}\cong 800$ μm, $L_{S2}\cong 570$ μm, and $C\cong 2.5$ μm.

Figure 8A:
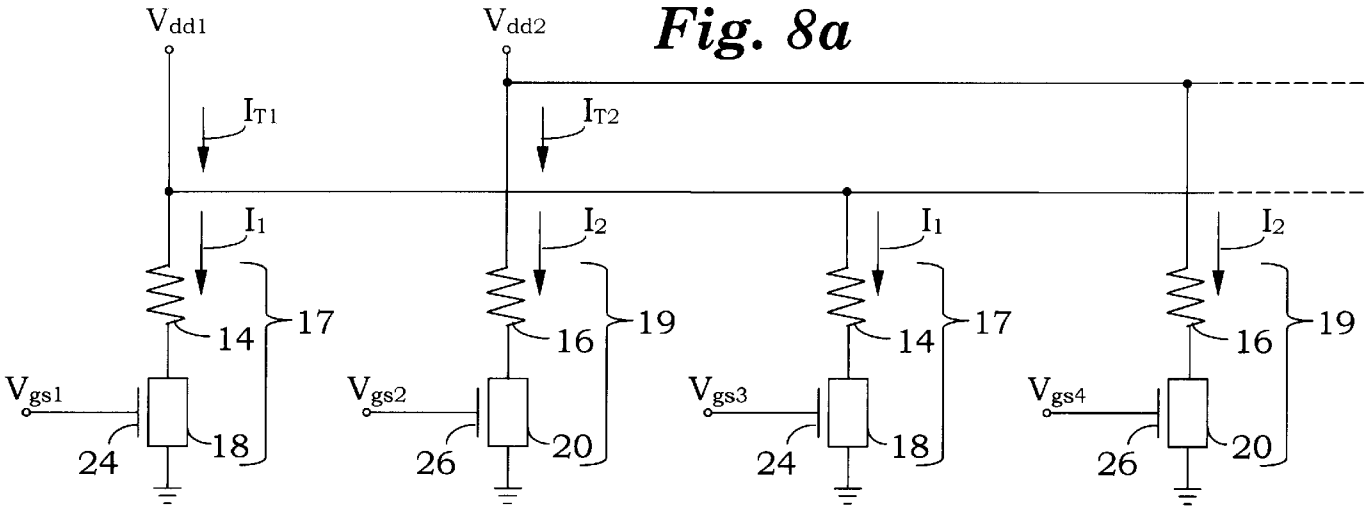
FIG. 8*a* and 8*b* are schematic diagrams of alternative embodiments of the present invention.
Figure 8B:
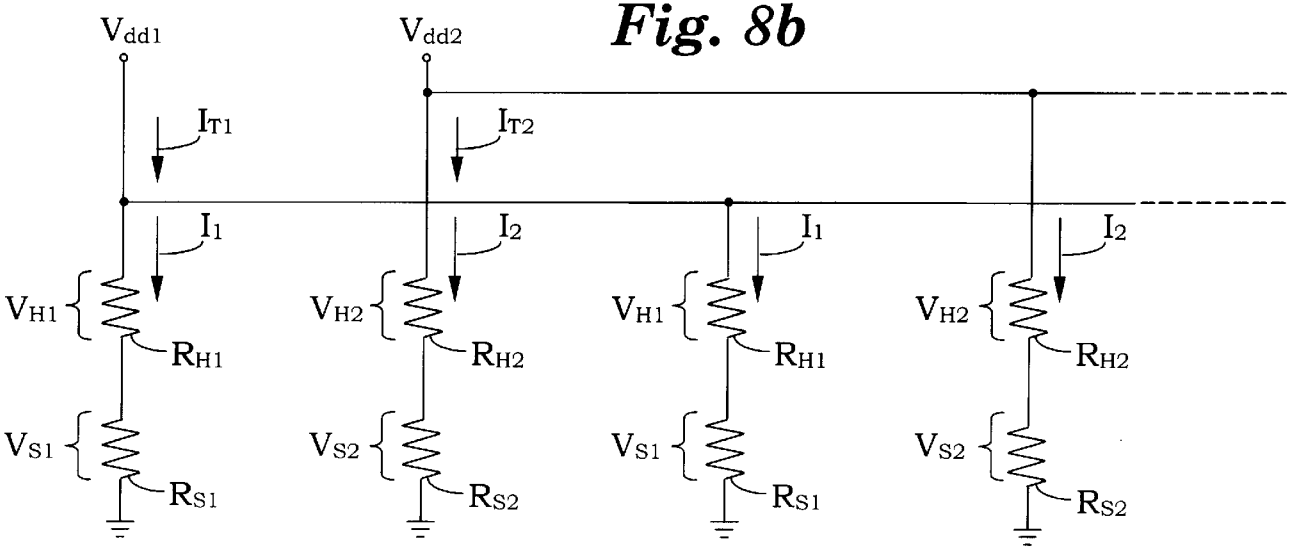

In an alternative embodiment of the invention shown in FIG. 8*a*, first and second voltage sources, $V_{dd1}$ and $V_{dd2}$, are provided to drive the first and second heater-switch pairs 17 and 19. In this embodiment, the first heater-switch pairs 17 are connected in parallel across the first voltage source $V_{dd1}$, and the second heater-switch pairs 19 are connected in parallel across the second voltage source $V_{dd2}$. With separate voltage sources, the heat energy generated by the heaters 14 and 16 may be tailored to the ink droplet size by adjusting the voltage $V_{dd1}$ relative to the voltage $V_{dd2}$, rather than by adjusting the resistance $R_{H1}$ relative to $R_{H2}$. Preferably, the voltage $V_{dd2}$ is less than the voltage $V_{dd1}$, such that the second heaters 16 generate less heat energy when activated than do the first heaters 14.

According to this second embodiment, the heaters 14 and 16 may both be square and thus have equivalent resistances ($R_{H1}=R_{H2}$). However, as with the first embodiment, the areas of the heaters 14 and 16 in the second embodiment are preferably maintained at 441 and 276 square microns, respectively. As discussed above, this provides for the most efficient energy transfer for generating ink droplets of two different sizes. Preferably, for each large heater 14 of the second embodiment, $W_{H1}$ and $L_{H1}$ are approximately 21 microns. For each small heater 16 of the second embodiment, $W_{H2}$ and $L_{H2}$ are preferably about 16.6 microns.

Figure 9:
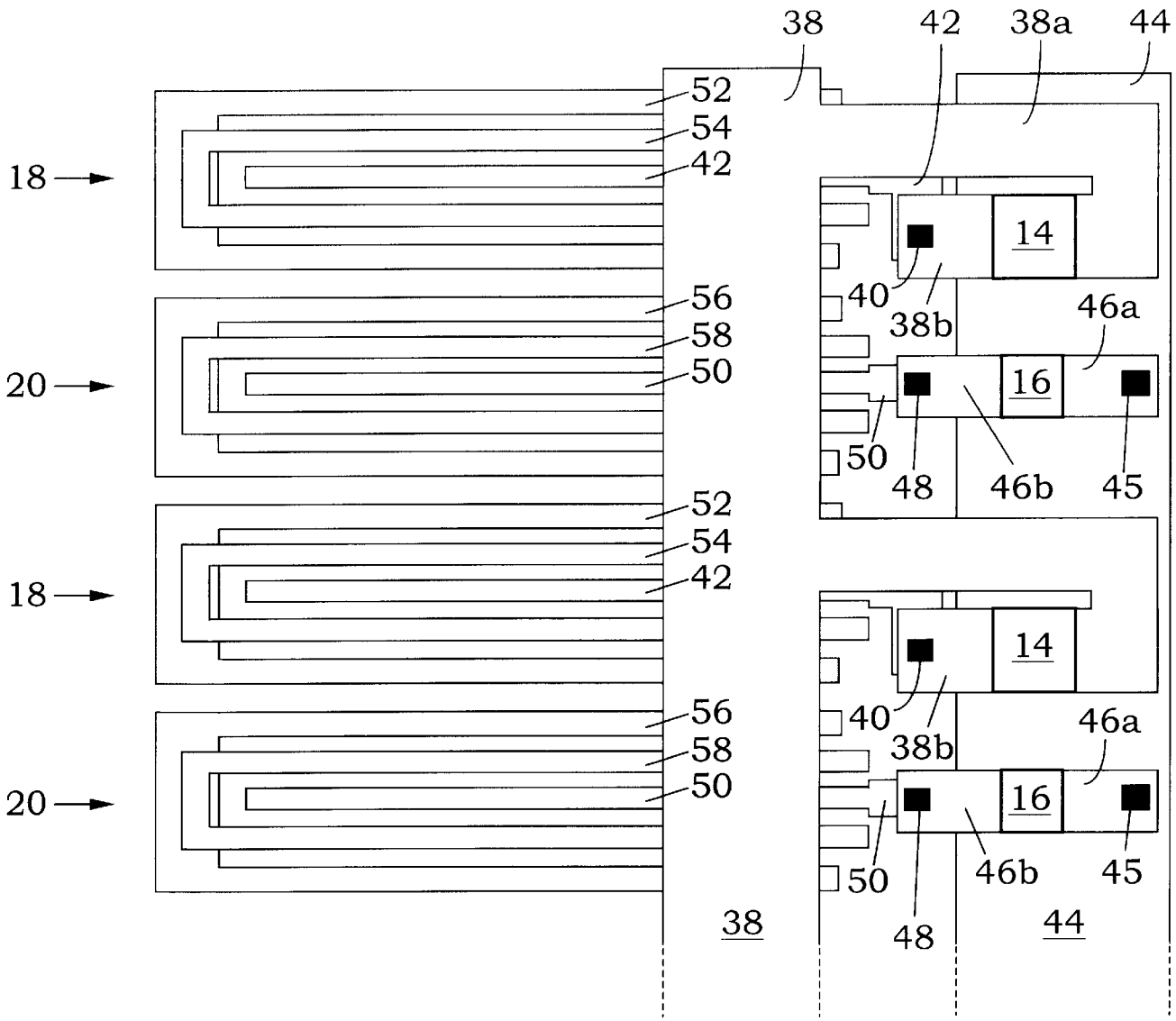
FIG. 9 depicts an alternative embodiment of an exemplary portion of the heater wiring geometry.

A wiring configuration according to the second embodiment connecting the vertically alternating heaters 14 and 16 to the two different voltage sources, $V_{dd1}$ and $V_{dd2}$, is shown in FIG. 9. A first metal bus 38, which is connected to the voltage source $V_{dd1}$, preferably resides at the same chip layer as the heaters 14 and 16. The bus 38 is connected to metal traces 38*a* which supply the voltage $V_{dd1}$ to one side of the large heaters 14. The other sides of the large heaters 14 are connected to metal traces 38*b* in the same layer. The metal traces 38*b* are connected, by way of vias 40, to drains 42 of the first switching devices 18 which reside in a layer below the large heaters 14.

A second metal bus 44 is connected to the voltage source $V_{dd2}$. The bus 44 preferably resides at a chip layer below the layer containing the heaters 14 and 16, such as the layer containing the switching devices 18 and 20. The bus 44 is connected, by way of vias 45, to metal traces 46*a* residing at the same layer as the heaters 14 and 16. The traces 46*a* are connected to one side of the small heaters 16. Thus, the voltage $V_{dd2}$ is supplied to one side of the small heaters 16 by way of the bus 44, the vias 45, and the traces 46*a*. Metal traces 46*b*, also residing in the same layer as the heaters 14 and 16, are connected to the other side of the small heaters 16. The metal traces 46*b* are connected, by way of vias 48, to drains 50 of the second switching devices 20, which preferably reside in the same layer as the first switching devices 18. Also, shown in FIG. 9 are sources 52 and gates 54 of the first switching devices 18, and sources 56 and gates 58 of the second switching devices 20.

Thus, using only two metal layers, the wiring configuration of FIG. 9 provides the two separate voltage rails $V_{dd1}$ and $V_{dd2}$ to the vertically alternating large and small heaters 14 and 16. FIG. 9 depicts an exemplary portion of the heater wiring geometry, and it will be appreciated that the pattern shown in FIG. 9 repeats in the vertical dimension to form the rest of the heater array.

It is contemplated, and will be apparent to those skilled in the art from the preceding description and the accompanying drawings that modifications and/or changes may be made in the embodiments of the invention. For example, the invention is not limited to the relationship of equation (9). The benefits of the invention may be realized using other ratios of switching device resistances. Also, the invention is not limited to the dimensions determined in the above example. The invention may be scaled to accommodate other ink droplet sizes, nozzle diameters, nozzle-to-nozzle spacings, heater dimensions, and switching device dimensions. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An ink jet print head having a plurality of nozzles through which droplets of ink are ejected toward a print medium, the plurality of nozzles including first nozzles having a first diameter for ejecting droplets of ink having a first mass, and second nozzles having a second diameter for ejecting droplets of ink having a second mass, where the first diameter is larger than the second diameter, and the first mass is larger than the second mass, the print head comprising:

a nozzle plate containing the plurality of nozzles;

a substrate disposed adjacent the nozzle plate;

first heaters disposed on the substrate adjacent the first nozzles, each of the first heaters being associated with a corresponding first nozzle, each of the first heaters comprising electrically resistive material and having a first heater electrical resistance, each of the first heaters generating heat as a first electrical current flows substantially in a first direction through the electrically resistive material;

first switching devices disposed on the substrate adjacent the first heaters, each of the first switching devices being connected electrically in series with a corresponding first heater, the first switching devices each having a first switch electrical resistance;

second heaters disposed on the substrate adjacent the second nozzles, each of the second heaters being associated with a corresponding second nozzle, each of the second heaters comprising electrically resistive material and having a second heater electrical resistance, each of the second heaters generating heat as a second electrical current flows substantially in the first direction through the electrically resistive material; and second switching devices disposed on the substrate adjacent the second heaters, each of the second switching devices being connected electrically in series with a corresponding second heater, the second switching devices each having a second switch electrical resistance, wherein the second switch electrical resistance is larger than the first switch electrical resistance.

2. The print head of claim 1 wherein the first heater resistance is smaller than the second heater resistance.

3. The print head of claim 1 further comprising:

the first heaters each occupying a first heater area on the substrate defined by a first heater length in the first direction and a first heater width in a second direction which is orthogonal to the first direction, and the second heaters each occupying a second heater area on the substrate defined by a second heater length in the first direction and a second heater width in the second direction, wherein the second heater width is smaller than the first heater width.

4. The print head of claim 1 further comprising:

the first heaters each occupying a first heater area on the substrate defined by a first heater length in the first direction and a first heater width in a second direction which is orthogonal to the first direction, and the second heaters each occupying a second heater area on the substrate defined by a second heater length in the first direction and a second heater width in the second direction, wherein the second heater length is larger than the first heater length.

5. The print head of claim 1 further comprising:

the first heaters each occupying a first heater area on the substrate; and the second heaters each occupying a second heater area on the substrate, wherein the second heater area is smaller than the first heater area.

6. The print head of claim 1 further comprising:

the first switching devices each occupying a first switch area on the substrate, the first switch area defined by a first switch length in the first direction and a first switch width in a second direction which is orthogonal to the first direction, and the second switching devices each occupying a second switch area on the substrate, the second switch area defined by a second switch length in the first direction and a second switch width in the second direction, wherein the first switch width is larger than the second switch width.

7. The print head of claim 1 further comprising:

the first switching devices each occupying a first switch area on the substrate, the first switch area defined by a first switch length in the first direction and a first switch width in a second direction which is orthogonal to the first direction, and the second switching devices each occupying a second switch area on the substrate, the second switch area defined by a second switch length in the first direction and a second switch width in the second direction, wherein the first switch length is larger than the second switch length.

8. The print head of claim 1 further comprising:

the first switching devices each occupying a first switch area on the substrate, and the second switching devices each occupying a second switch area on the substrate, wherein the first switch area is larger than the second switch area.

9. The print head of claim 1 further comprising:

the first switching devices disposed in first positions aligned in a second direction which is perpendicular to the first direction; and the second switching devices disposed in second positions aligned in the second direction, wherein the first positions alternate with the second positions.

10. An ink jet print head having a plurality of nozzles through which droplets of ink are ejected toward a print medium, the plurality of nozzles including first nozzles having a first diameter for ejecting droplets of ink having a first mass, and second nozzles having a second diameter for ejecting droplets of ink having a second mass, where the first diameter is larger than the second diameter, and the first mass is larger than the second mass, the print head comprising:

a nozzle plate containing the plurality of nozzles;

a substrate disposed adjacent the nozzle plate;

first heaters disposed on the substrate adjacent the first nozzles, each of the first heaters being associated with a corresponding first nozzle, each of the first heaters comprising electrically resistive material and generating heat as a first electrical current flows substantially in a first direction through the electrically resistive material;

first switching devices disposed on the substrate adjacent the first heaters, each of the first switching devices being connected electrically in series with a corresponding first heater, each of the first switching devices occupying a first switch area on the substrate;

second heaters disposed on the substrate adjacent the second nozzles, each of the second heaters being associated with a corresponding second nozzle, each of the second heaters comprising electrically resistive material and generating heat as a second electrical current flows substantially in the first direction through the electrically resistive material; and second switching devices disposed on the substrate adjacent the second heaters, each of the second switching devices being connected electrically in series with a corresponding second heater, each of the second switching devices occupying a second switch area on the substrate, wherein the first switch area is larger than the second switch area.

11. The print head of claim 10 further comprising:

the first heaters each having a first heater electrical resistance; and the second heaters each having a second heater electrical resistance, wherein the first heater electrical resistance is smaller than the second heater electrical resistance.

12. The print head of claim 10 further comprising:

the first heaters each occupying a first heater area on the substrate defined by a first heater length in the first direction and a first heater width in a second direction which is orthogonal to the first direction, and the second heaters each occupying a second heater area on the substrate defined by a second heater length in the first direction and a second heater width in the second direction, wherein the second heater width is smaller than the first heater width.

13. The print head of claim 10 further comprising:

the first heaters each occupying a first heater area on the substrate defined by a first heater length in the first direction and a first heater width in a second direction which is orthogonal to the first direction, and the second heaters each occupying a second heater area on the substrate defined by a second heater length in the first direction and a second heater width in the second direction, wherein the second heater length is larger than the first heater length.

14. The print head of claim 10 further comprising:

the first heaters each occupying a first heater area on the substrate, and the second heaters each occupying a second heater area on the substrate, wherein the first heater area is larger than the second heater area.

15. The print head of claim 10 further comprising:

the first switching devices each occupying a first switch area on the substrate, the first switch area defined by a first switch length in the first direction and a first switch width in a second direction which is orthogonal to the first direction, and the second switching devices each occupying a second switch area on the substrate, the second switch area defined by a second switch length in the first direction and a second switch width in the second direction, wherein the first switch width is larger than the second switch width.

16. The print head of claim 10 further comprising:

the first switching devices each occupying a first switch area on the substrate, the first switch area defined by a first switch length in the first direction and a first switch width in a second direction which is orthogonal to the first direction, and the second switching devices each occupying a second switch area on the substrate, the second switch area defined by a second switch length in the first direction and a second switch width in the second direction, wherein the first switch length is larger than the second switch length.

17. The print head of claim 10 further comprising:

the first switching devices each having a first switch electrical resistance; and the second switching devices each having a second switch electrical resistance, wherein the first switch electrical resistance is smaller than the second switch electrical resistance.

18. The print head of claim 10 further comprising:

the first switching devices disposed in first positions aligned in a second direction which is perpendicular to the first direction; and the second switching devices disposed in second positions aligned in the second direction, wherein the first positions alternate with the second positions.

19. An ink jet print head having a plurality of nozzles through which droplets of ink are ejected toward a print medium, the plurality of nozzles including first nozzles having a first diameter for ejecting droplets of ink having a first mass, and second nozzles having a second diameter for ejecting droplets of ink having a second mass, where the first diameter is larger than the second diameter, and the first mass is larger than the second mass, the print head comprising:

a nozzle plate containing the plurality of nozzles;

a substrate disposed adjacent the nozzle plate;

first heater-switch pairs comprising:

first heaters disposed on the substrate adjacent the first nozzles, each of the first heaters being associated with a corresponding first nozzle, each of the first heaters comprising electrically resistive material occupying a first heater area on the substrate, each of the first heaters developing a first heater voltage drop as a first electrical current flows through the each of the first heaters; and first switching devices disposed on the substrate adjacent the first heaters and connected electrically in series with the first heaters, each of the first switching devices developing a first switching device voltage drop as the first electrical current flows through each of the first switching devices; and second heater-switch pairs comprising:

second heaters disposed on the substrate adjacent the second nozzles, each of the second heaters being associated with a corresponding second nozzle, each of the second heaters comprising electrically resistive material occupying a second heater area on the substrate, each of the second heaters developing a second heater voltage drop as a second electrical current flows through the each of the second heaters; and second switching devices disposed on the substrate adjacent the second heaters and connected electrically in series with the second heaters, each of the second switching devices developing a second switching device voltage drop as the second electrical current flows through each of the second switching devices, wherein the first heater-switch pairs are connected electrically in parallel with the second heater-switch pairs, the first heater area is larger than the second heater area, and the first switching device voltage drop is substantially equivalent to the second switching device voltage drop.

20. An ink jet print head having a plurality of nozzles through which droplets of ink are ejected toward a print medium, the plurality of nozzles including first nozzles having a first diameter for ejecting droplets of ink having a first mass, and second nozzles having a second diameter for ejecting droplets of ink having a second mass, where the first diameter is larger than the second diameter, and the first mass is larger than the second mass, the print head comprising:

a nozzle plate containing the plurality of nozzles;

a substrate disposed adjacent the nozzle plate;

first heater-switch pairs connected to a first voltage source for supplying a first voltage across the first heater-switch pairs, the first heater-switch pairs comprising:

first heaters disposed on the substrate adjacent the first nozzles, each of the first heaters being associated with a corresponding first nozzle, each of the first heaters comprising electrically resistive material occupying a first heater area on the substrate, each of the first heaters having a first electrical resistance; and first switching devices disposed on the substrate adjacent the first heaters and connected electrically in series with the first heaters; and second heater-switch pairs connected to a second voltage source for supplying a second voltage across the second heater-switch pairs, the second voltage being smaller than the first voltage, the second heater-switch pairs comprising:

second heaters disposed on the substrate adjacent the second nozzles, each of the second heaters being associated with a corresponding second nozzle, each of the second heaters comprising electrically resistive material occupying a second heater area on the substrate that is smaller than the first heater area, each of the second heaters having a second electrical resistance that is substantially equivalent to the first electrical resistance; and second switching devices disposed on the substrate adjacent the second heaters and connected electrically in series with the second heaters.

* * * * *